US005499760A

United States Patent [19]

Pielocik

[11] Patent Number: 5,499,760

[45] Date of Patent: Mar. 19, 1996

[54] INTERCONVERTIBLE BACKPACK AND CHAIR APPARATUS

[76] Inventor: William P. Pielocik, 421 High St., Clinton, Mass. 01510

[21] Appl. No.: 238,698

[22] Filed: May 5, 1994

[51] Int. Cl.[6] ..... A47C 13/00

[52] U.S. Cl. ..... 224/155; 297/129

[58] Field of Search ..... 224/155; 190/8; 297/129; D6/335

[56] References Cited

U.S. PATENT DOCUMENTS

| | | | |
|---|---|---|---|
| D. 308,439 | 6/1990 | Van Winkle | D6/335 X |
| 3,266,686 | 8/1966 | Griffith | 224/155 |
| 3,315,856 | 4/1967 | Black | 224/155 |
| 4,487,345 | 12/1984 | Pierce et al. | 224/155 |
| 4,489,866 | 12/1984 | Korte . | |
| 4,955,517 | 9/1990 | Maresca . | |
| 5,016,792 | 5/1991 | Jay | 224/155 |
| 5,139,308 | 8/1992 | Ziman | 297/129 X |
| 5,186,372 | 2/1993 | Biedenharn, Jr. . | |

FOREIGN PATENT DOCUMENTS

| | | | |
|---|---|---|---|
| 1194851 | 6/1970 | United Kingdom | 224/155 |

*Primary Examiner*—Renee S. Luebke

[57] ABSTRACT

A new and improved interconvertible backpack and chair apparatus includes a first frame assembly which includes a pair of retractable first legs which are capable of supporting a rolled-up sleeping bag when the apparatus is in a backpack mode. The first legs serve as rear legs of a chair when the apparatus is in a chair mode. A first storage compartment is attached to the top end of the first frame assembly. A first hinge assembly connects the bottom end of the first frame assembly to the back end of a second frame assembly and permits the second frame assembly to be rotated with respect to the first frame assembly when the apparatus is shifted from a backpack mode to a chair mode and vice versa. A seat assembly is attached to the first frame assembly and is in alignment with the first storage compartment when the apparatus is in a backpack mode, and the seat assembly is oriented at right angles to the first storage compartment when the apparatus is in a chair mode. A third frame assembly serves as the front legs in the chair mode. A second hinge assembly connects the front end of the second frame assembly to the top end of the third frame assembly. The second hinge assembly permits the third frame assembly to be rotated with respect to the second frame assembly when the apparatus is shifted from a backpack mode to a chair mode and vice versa.

7 Claims, 4 Drawing Sheets

INTERCONVERTIBLE BACKPACK AND CHAIR APPARATUS

BACKGROUND OF THE INVENTION

1. Field of the Invention

The present invention relates generally to backpacks and to chairs and, more particularly, to backpacks that can be converted into chairs and vice versa.

2. Description of the Prior Art

Hiking with a backpack is a popular recreational activity. During backpacking, rest breaks are necessary, and one often wants to sit down during a rest break. One may sit on the ground, but, for a number of reasons, sitting on the ground may not be desirable. The ground may be wet or muddy; the ground may be cold; the ground may have ants or other insects. To avoid the problems of sitting on the ground, throughout the years, a number of innovations have been developed relating to interconvertible backpack and chair devices, and the following U.S. Pat. Nos. are representative of some of those innovations: 4,489,866; 4,487,345; 4,955,517; 5,016,792; and 5,186,372.

More specifically, U.S. Pat. No. 4,489,866 discloses a backpack that has a foldout seat wherein the mechanism that connects the foldout seat to the backpack is a scissors-like mechanism which includes fulcrum points and short and long lever arms on either side of each fulcrum point. When a scissors-like mechanism is employed, clothing or body parts can be caught between moving lever arms. The result can be torn clothing or pinched body parts. In this respect, it would be desirable if an interconvertible backpack to chair device were provided which did not use a scissors-like mechanism to deploy a chair.

U.S. Pat. No. 4,487,345 discloses a backpack chair that is in the form of a chaise lounge. The chaise lounge includes arm rests in addition to a back and seat portion. The arm rests are integral components in the structural integrity of the chaise lounge. Many hikers do not need the luxury of arm rests in a seat that is used during a rest break during a hike. Moreover, many backpackers would not appreciate carrying the extra weight of the chaise lounge arm rests throughout a hike. In this respect, it would be desirable if an interconvertible backpack to chair device were provided which does not include arm rests.

U.S. Pat. No. 4,955,517 discloses another combination backpack and chaise lounge. With this device, numerous structural components are provided for supporting the backpackers legs in a horizontal orientation during use of the chaise lounge. Many backpackers do not need or want to place their legs in a horizontal orientation during a rest break. Moreover, many backpackers would not want to carry the extra weight of the leg-supporting structures during a hike. In this respect, it would be desirable if an interconvertible backpack to chair device were provided which did not include structures for supporting legs in a horizontal orientation.

U.S. Pat. No. 5,016,792 discloses an interconvertible backpack and chair device wherein the chair is a beach-type chair that is close to the ground. Moreover, it appears that the backpack storage components are separated from the chair components when the chair is in use. A backpacker may not desire to be required to go through a disassembly and reassembly procedure each time the backpacker takes a rest break and uses a backpack chair. In this respect, it would be desirable if an interconvertible backpack to chair device were provided which does not require separating a chair assembly from a backpack assembly in order to use the chair assembly.

U.S. Pat. No. 5,186,372 discloses a combination backpack and stool which employs a large, X-shaped support for the stool legs. Such a large X-shaped stool leg support must be carried by the backpacker when a hike is in progress. Such extra weight and bulk may be very inconvenient and undesirable to carry during a hike. In this respect, it would be desirable if an interconvertible backpack to chair device were provided which does not include a large, X-shaped leg support for a backpack chair.

Still other features would be desirable in an interconvertible backpack and chair apparatus. For example, it would be desirable if a backpack assembly included two separate and distinct storage compartments rather than one big storage compartment.

A rolled-up sleeping bag is often included as an item carried by a backpacker. In this respect, it would be desirable if an interconvertible backpack to chair device were provided that had specific provisions for conveniently carrying a rolled up sleeping bag.

Once a chair formation is set up from a backpack, it is important that the chair have appropriate structural strength to support the weight of a sitting backpacker. In this respect, it would be desirable if an interconvertible backpack to chair device were provided with strong, lightweight structural reinforcements to sustain the backpack chair in a chair formation.

The terrain on which a backpack chair will rest may be relatively soft. To prevent the legs of the backpack from sinking into soft terrain, it would be desirable if the backpack chair were equipped with feet having a relatively broad surface area.

Thus, while the foregoing body of prior art indicates it to be well known to use interconvertible backpack and chair apparatuses, the prior art described above does not teach or suggest an interconvertible backpack and chair apparatus which has the following combination of desirable features: (1) does not use a scissors-like mechanism to deploy a chair; (2) does not include arm rests; (3) does not include structures for supporting legs in a horizontal orientation; (4) does not require separating a chair assembly from a backpack assembly in order to use the chair assembly; (5) does not include a large, X-shaped leg support for a backpack chair; (6) includes two separate and distinct storage compartments rather than one big storage compartment; (7) has specific provisions for conveniently carrying a rolled up sleeping bag; (8) is provided with strong, lightweight structural reinforcements to sustain the backpack chair in a chair formation; and (9) has a backpack chair that is equipped with feet having a relatively broad surface area. The foregoing desired characteristics are provided by the unique interconvertible backpack and chair apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved interconvertible backpack and chair apparatus which includes a first frame assembly which includes a top end, a bottom end, a front side, and a back side. The first frame assembly includes a pair of retractable first legs. The first legs are capable of supporting a rolled-up sleeping bag when the apparatus is in a backpack mode, and the first legs are capable of serving as rear legs of a chair when the apparatus is in a chair mode. A pair of selectable lock assemblies are supported by the first frame assembly for selectively locking the retractable first legs in an extended position. A first transverse member is connected between the pair of retractable first legs.

A strap is connected to the first frame assembly enabling a person to carry the apparatus on one's back in a backpack mode. A first storage compartment is attached to the top end of the first frame assembly. A flexible hinge assembly is provided for attaching the first storage compartment to the first frame assembly. The first storage compartment is capable of being located on the front side of the first frame assembly when the apparatus is in a backpack mode, and the first storage compartment is capable of being shifted around the flexible hinge assembly to be located on the back side of the first frame assembly when the apparatus is in a chair mode.

A second frame assembly includes a back end, a front end, a bottom side, and a top side. A first hinge assembly connects the bottom end of the first frame assembly to the back end of the second frame assembly. The first hinge assembly permits the second frame assembly to be rotated with respect to the first frame assembly when the apparatus is shifted from a backpack mode to a chair mode and vice versa.

A seat assembly is attached to the top side of the first frame assembly. The seat assembly is in alignment with the first storage compartment when the apparatus is in a backpack mode, and the seat assembly is oriented at right angles to the first storage compartment when the apparatus is in a chair mode.

A third frame assembly includes a top end and a bottom end. The third frame assembly serves as the front legs in the chair mode. A second hinge assembly connects the front end of the second frame assembly to the top end of the third frame assembly. The second hinge assembly permits the third frame assembly to be rotated with respect to the second frame assembly when the apparatus is shifted from a backpack mode to a chair mode and vice versa.

A second storage compartment is attached to the bottom side of the second frame assembly. The second storage compartment is in alignment with the first storage compartment when the apparatus is in a backpack mode, and the second storage compartment is oriented at right angles to the first storage compartment when the apparatus is in a chair mode.

The first frame assembly has an internal first width. The second frame assembly has an external second width and an internal third width. The seat assembly has an external second width. The third frame assembly has an external fourth width. The external second width is less than the internal first width such that the second frame assembly is nested within the first frame assembly when the apparatus is in a backpack orientation. The external fourth width is less than the internal third width such that the third frame assembly is nested within the second frame assembly when the apparatus is in a backpack orientation.

A pair of flexible reinforcement assemblies is connected between the first legs of the first frame assembly and the third frame assembly for preventing the third frame assembly from moving out of a parallel orientation distally with respect to the first legs.

Flat feet assemblies are connected to end portions of the third frame assembly and to end portions of the first legs of the first frame assembly. The flat feet assemblies include a leg-receiving portion, and a flat foot portion attached to the leg-receiving portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved interconvertible backpack and chair apparatus which has all of the advantages of the prior art and none of the disadvantages.

It is another object of the present invention to provide a new and improved interconvertible backpack and chair apparatus which may be easily and efficiently manufactured and marketed.

It is a further object of the present invention to provide a new and improved interconvertible backpack and chair apparatus which is of durable and reliable construction.

An even further object of the present invention is to provide a new and improved interconvertible backpack and chair apparatus which is susceptible of a low cost of manufacture with regard to both materials and labor, and which accordingly is then susceptible of low prices of sale to the consuming public, thereby making such interconvertible backpack and chair apparatus available to the buying public.

Still yet a further object of the present invention is to provide a new and improved interconvertible backpack and chair apparatus which does not use a scissors-like mechanism to deploy a chair.

Still another object of the present invention is to provide a new and improved interconvertible backpack and chair apparatus that does not include arm rests.

Yet another object of the present invention is to provide a new and improved interconvertible backpack and chair apparatus which does not include structures for supporting legs in a horizontal orientation.

Even another object of the present invention is to provide a new and improved interconvertible backpack and chair apparatus that does not require separating a chair assembly from a backpack assembly in order to use the chair assembly.

Still a further object of the present invention is to provide a new and improved interconvertible backpack and chair apparatus which does not include a large, X-shaped leg support for a backpack chair.

Yet another object of the present invention is to provide a new and improved interconvertible backpack and chair apparatus that includes two separate and distinct storage compartments rather than one big storage compartment.

Still another object of the present invention is to provide a new and improved interconvertible backpack and chair apparatus which has specific provisions for conveniently carrying a rolled up sleeping bag.

Yet another object of the present invention is to provide a new and improved interconvertible backpack and chair apparatus that is provided with strong, lightweight structural reinforcements to sustain the backpack chair in a chair formation.

Still a further object of the present invention is to provide a new and improved interconvertible backpack and chair apparatus that has a backpack chair that is equipped with feet having a relatively broad surface area.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved interconvertible backpack and chair apparatus embodying the principles and concepts of the present invention will be described.

Figure 1:
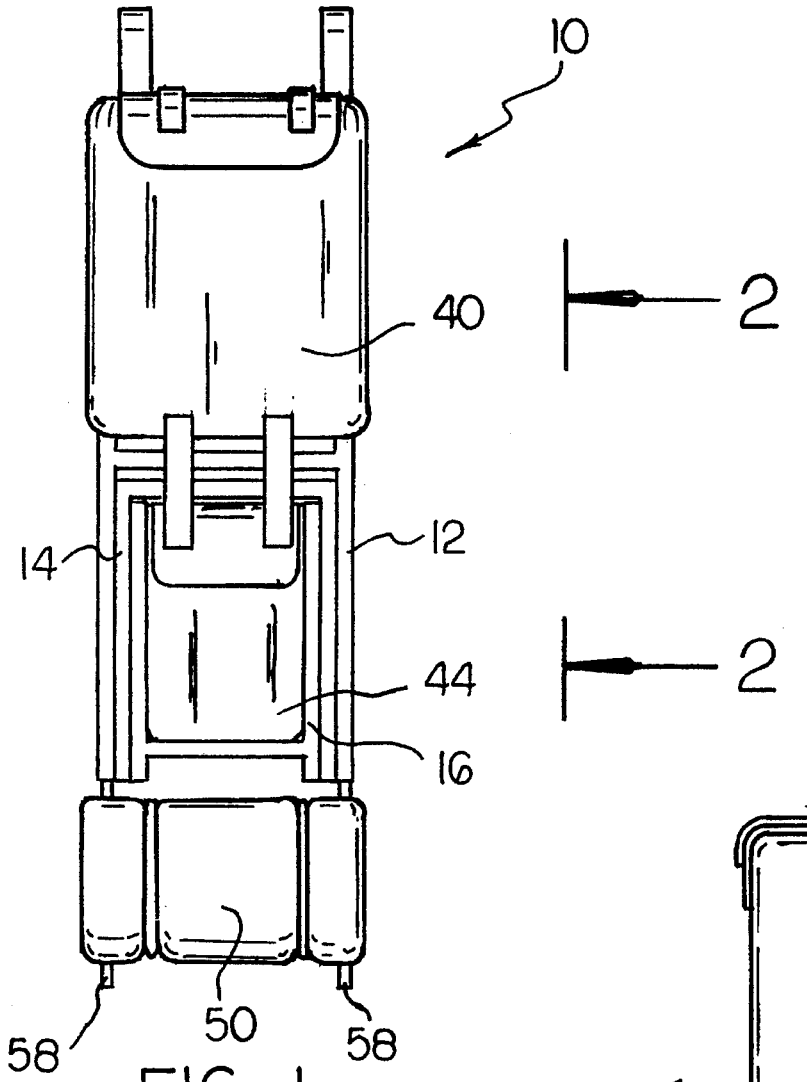
FIG. 1 is a front view showing a preferred embodiment of the interconvertible backpack and chair apparatus of the invention in its backpack orientation.
Figure 2:
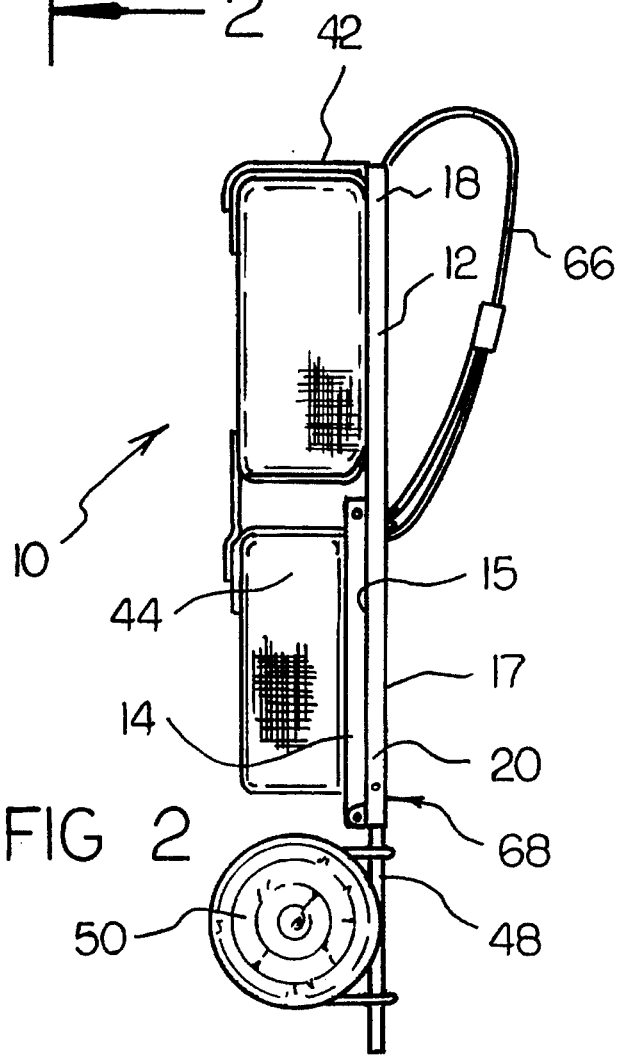
FIG. 2 is a side view of the embodiment of the interconvertible backpack and chair apparatus shown in FIG. 1 taken along line 2—2 of FIG. 1.
Figure 3:
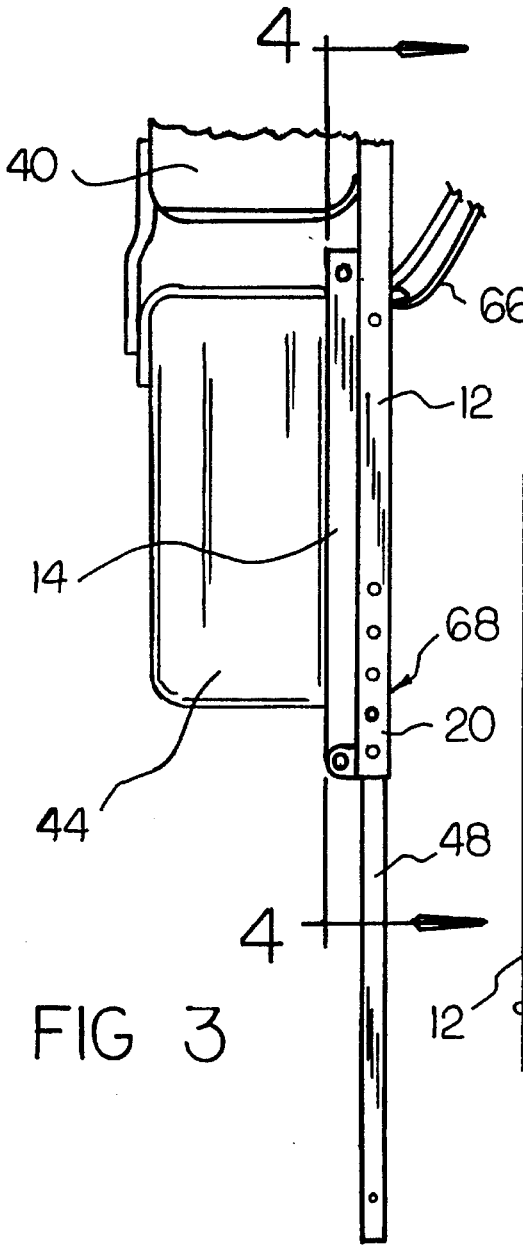
FIG. 3 is an enlarged partial side view of the embodiment of the interconvertible backpack and chair apparatus of FIG. 2 with rear chair legs in a lowered position.
Figure 4:
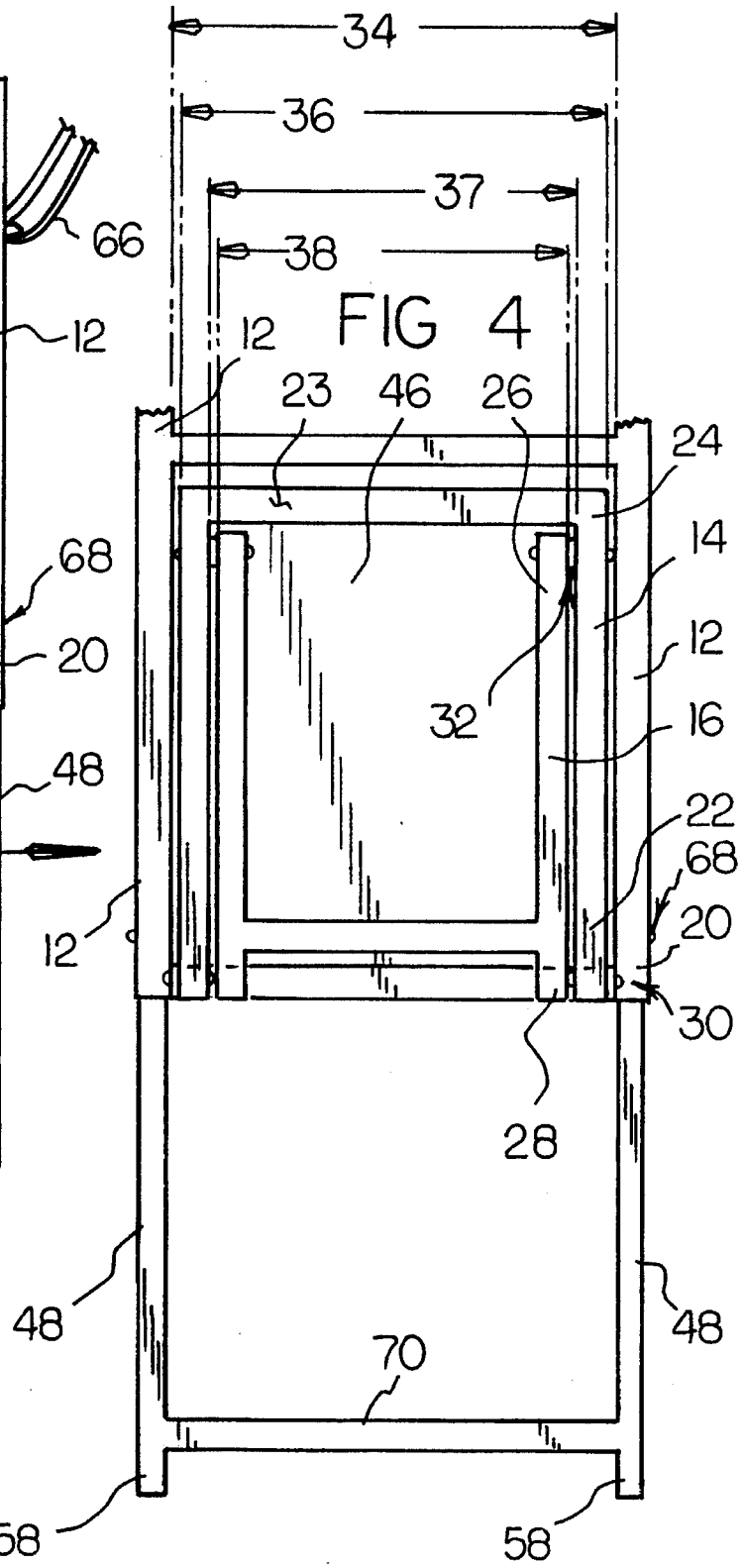
FIG. 4 is a front view of the portion of the embodiment of the invention shown in FIG. 3 taken along line 4—4 of FIG. 3.
Figure 5:
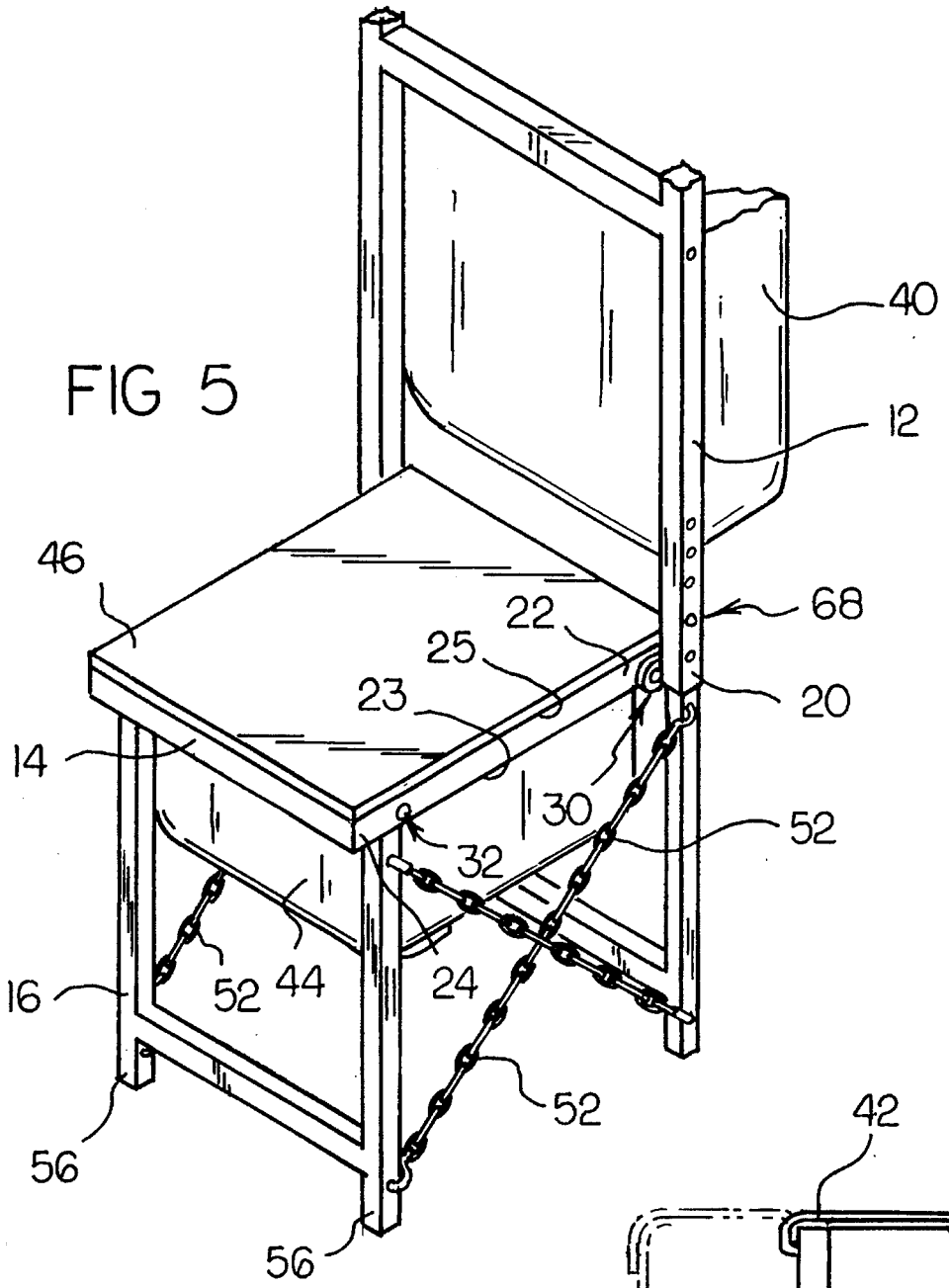
FIG. 5 is a perspective view of the embodiment of the invention shown in FIG. 4 with both the front and rear legs of the chair formation of the invention in an extended orientation.
Figure 6:
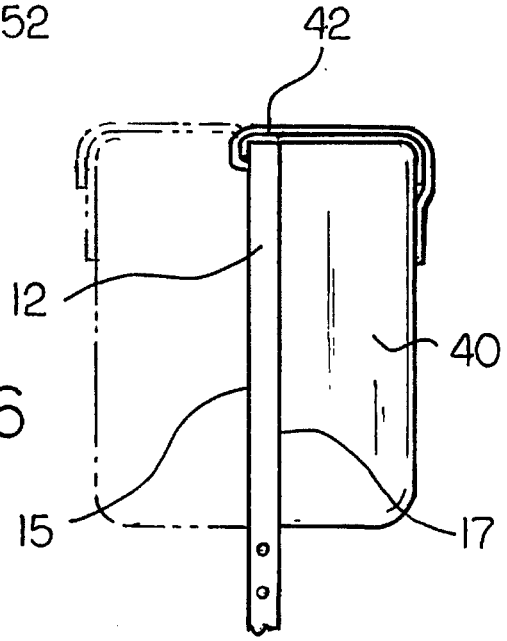
FIG. 6 is a partial side view of the top portion of the embodiment of the invention shown in FIG. 1 which shows how the top storage compartment in the backpack orientation shown in dashed lines is moved to its position for the chair orientation, shown in solid lines.
Figure 7:
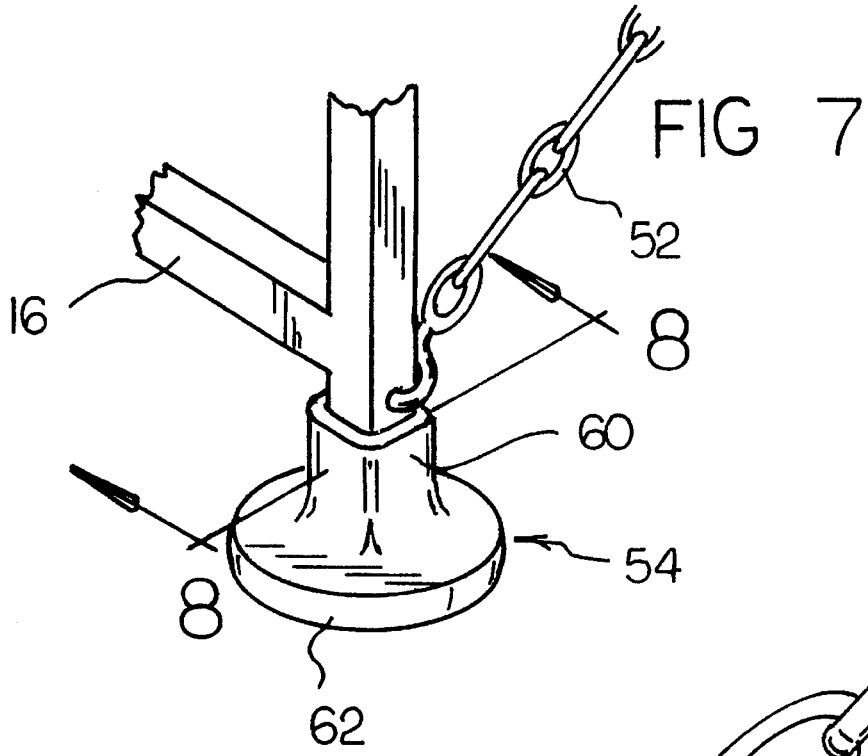
FIG. 7 is an enlarged perspective view of a wide foot used with a chair orientation of an embodiment of the invention.
Figure 8:
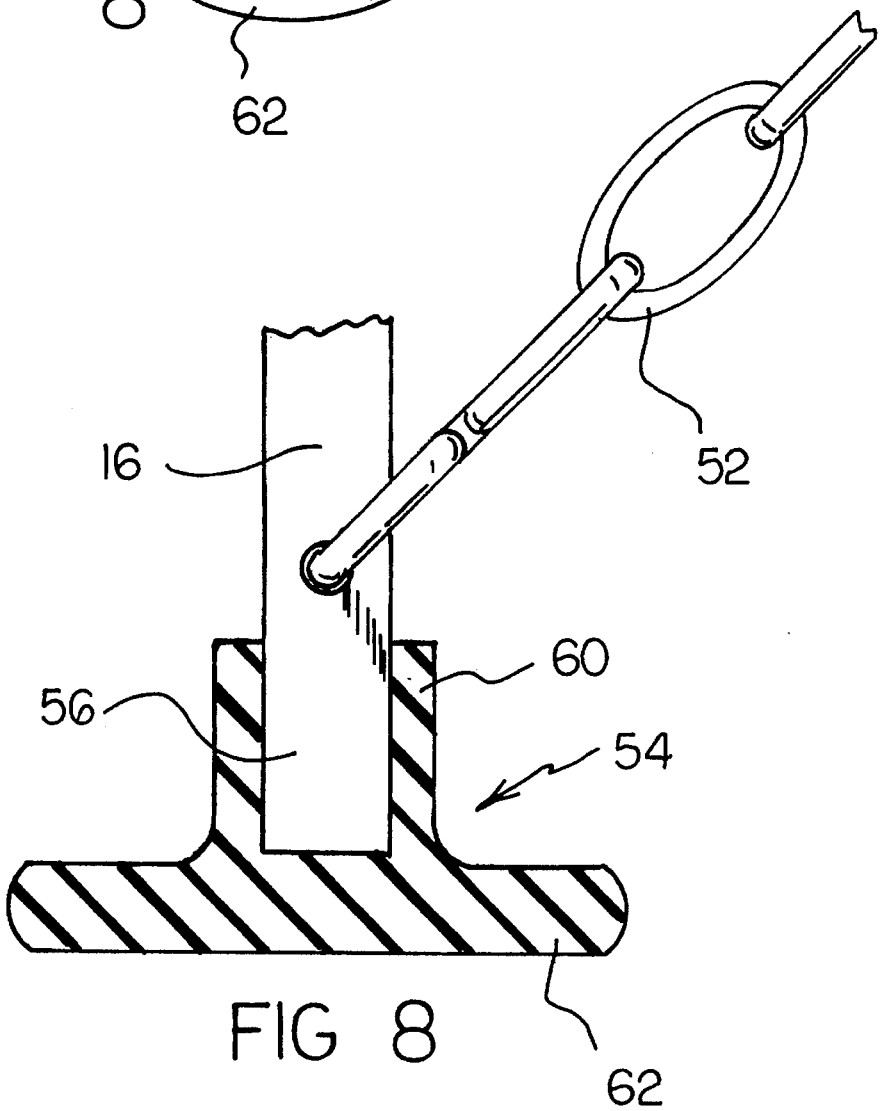
FIG. 8 is an enlarged cross-sectional view of the foot shown in FIG. 7 taken along line 8—8 of FIG. 7.

Turning to FIGS. 1–8, there is shown an exemplary embodiment of the interconvertible backpack and chair apparatus of the invention generally designated by reference numeral 10. In its preferred form, interconvertible backpack and chair apparatus 10 includes a first frame assembly 12 which includes a top end 18, a bottom end 20, a front side 15, and a back side 17. The first frame assembly 12 includes a pair of retractable first legs 48. The first legs 48 are capable of supporting a rolled-up sleeping bag 50 when the apparatus is in a backpack mode, and the first legs 48 are capable of serving as rear legs of a chair when the apparatus is in a chair mode. A pair of selectable lock assemblies 68 are supported by the first frame assembly 12 for selectively locking the retractable first legs 48 in an extended position. A strap 66 is connected to the first frame assembly 12 enabling a person to carry the apparatus on one's back in a backpack mode. A first storage compartment 40 is attached to the top end 18 of the first frame assembly 12. A flexible hinge assembly 42 is provided for attaching the first storage compartment 40 to the first frame assembly 12. The first storage compartment 40 is capable of being located on the front side 15 of the first frame assembly 12 when the apparatus is in a backpack mode as shown in FIGS. 1, 2, and 3, and the first storage compartment 40 is capable of being shifted around the flexible hinge assembly 42 to be located on the back side 17 of the first frame assembly 12 when the apparatus is in a chair mode as shown in FIGS. 5 and 6.

A second frame assembly 14 includes a back end 22, a front end 24, a bottom side 23, and a top side 25. A first hinge assembly 30 connects the bottom end 20 of the first frame assembly 12 to the back end 22 of the second frame assembly 14. The first hinge assembly 30 permits the second frame assembly 14 to be rotated with respect to the first frame assembly 12 when the apparatus is shifted from a backpack mode to a chair mode and vice versa.

A seat assembly 46 is attached to the top side 25 of the second frame assembly 14. The seat assembly 46 is in alignment with the first storage compartment 40 when the apparatus is in a backpack mode, and the seat assembly 46 is oriented at right angles to the first storage compartment 40 when the apparatus is in a chair mode. Inasmuch as the first frame assembly is pivotally connected to the second frame assembly via first hinge assembly 30, as described above, and seat assembly 46 is attached to the first frame assembly, the seat assembly 46 and the top side 25 may be quite easily pivotally rotated into the chair mode.

A third frame assembly 16 includes a top end 26 and a bottom end 28. The third frame assembly 16 serves as the front legs in the chair mode. A second hinge assembly 32 connects the front end 24 of the second frame assembly 14 to the top end 26 of the third frame assembly 16. The second hinge assembly 32 permits the third frame assembly 16 to be rotated with respect to the second frame assembly 14 when the apparatus is shifted from a backpack mode to a chair mode and vice versa.

A first transverse member 70 is connected between the pair of retractable first legs 48. The first transverse member 70 provides reinforcement to the retractable first legs 48.

The second storage compartment 44 is in alignment with the first storage compartment 40 when the apparatus is in a backpack mode, and the second storage compartment 44 is oriented at right angles to the first storage compartment 40 when the apparatus is in a chair mode such as shown in FIG. 5.

The first frame assembly 12 has an internal first width 34. The second frame assembly 14 has an external second width 36 and an internal third width 37. The seat assembly 46 has an external second width 36. The third frame assembly 16 has an external fourth width 38. The external second width 36 is less than the internal first width 34 such that the second frame assembly 14 is nested within the first frame assembly 12 when the apparatus is in a backpack orientation. The external fourth width 38 is less than the internal third width 37 such that the third frame assembly 16 is nested within the second frame assembly 14 when the apparatus is in a backpack orientation.

A pair of flexible reinforcement assemblies 52 are connected between the first legs 48 of the first frame assembly 12 and the third frame assembly 16 for preventing the third frame assembly 16 from moving out of a parallel orientation distally with respect to the first legs 48. The flexible reinforcement assemblies 52 are comprised of chains 52.

Flat feet assemblies 54 are connected to end portions 56 of the third frame assembly 16 and to end portions 58 of the first legs 48 of the first frame assembly 12. The flat feet assemblies 54 include a leg-receiving portion 60, and a flat foot portion 62 attached to the leg-receiving portion 60. The fiat feet assemblies 54 are made from a rubber material.

In use, first considering the backpack mode, as shown in FIGS. 1–4, the first storage compartment 40 and the second storage compartment 44 are in alignment on the front side 15 of the first frame assembly 12. The retractable first legs 48 are telescopically extended down from the first frame assembly 12, and a sleeping bag 50 is attached to the retractable first legs 48. Straps 66 are connected to the first frame assembly 12 and are used for carrying the interconvertible backpack and chair apparatus of the invention on a person's back in the backpack mode.

To convert the interconvertible backpack and chair apparatus of the invention from the backpack mode to the chair mode, the following steps are taken. The apparatus of the invention is removed from the back of a person. The retractable first legs 48 are maintained into their extended positions with the selectable lock assemblies 68 which include selectable lock assemblies 68 extending through aligned holes in the retractable first legs 48 and in the first frame assembly 12, substantially as shown. The second frame assembly 14 is rotated around the first hinge assembly 30 so that the second frame assembly 14 is substantially perpendicular to the first frame assembly 12. Then, the third frame assembly 16 is rotated around the second hinge assembly 32 so that the third frame assembly 16 is substantially perpendicular to the second frame assembly 14. In this orientation, the third frame assembly 16 is substantially parallel to the retractable first legs 48 and forms the front legs of the chair mode. The retractable first legs 48 form the rear legs of the chair mode.

In the chair mode, chains 52 are stretched between opposite ends of the retractable first legs 48 and the third frame assembly 16. The chains 52 prevent the retractable first legs 48 and the third frame assembly 16 from separating too far from one another and keep the retractable first legs 48 and the third frame assembly 16 substantially parallel to each other.

In the chair mode, the second storage compartment 44 is positioned below the second frame assembly 14.

The seat assembly 46 can be lifted above the second frame assembly 14 to gain access to the second storage compartment 44. If desired, the seat assembly 46 can be connected by a hinge assembly to the second frame assembly 14.

As shown in FIG. 6, when the interconvertible backpack and chair apparatus of the invention is in the chair mode, the first storage compartment 40 is shifted around the flexible hinge assembly 42 from the front side 15 of the first frame assembly 12 to the back side 17 of the first frame assembly 12. To convert back to the backpack mode from the chair mode, the above steps are reversed.

The components of the interconvertible backpack and chair apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved interconvertible backpack and chair apparatus that is low in cost, relatively simple in design and operation, and which may advantageously be used without employing a scissors-like mechanism to deploy a chair. With the invention, an interconvertible backpack and chair apparatus is provided which does not include arm rests. With the invention, an interconvertible backpack and chair apparatus is provided which does not include structures for supporting legs in a horizontal orientation. With the invention, an interconvertible backpack and chair apparatus is provided which does not require separating a chair assembly from a backpack assembly in order to use the chair assembly. With the invention, an interconvertible backpack and chair apparatus is provided which does not include a large, X-shaped leg support for a backpack chair. With the invention, an interconvertible backpack and chair apparatus is provided which includes two separate and distinct storage compartments rather than one big storage compartment. With the invention, an interconvertible backpack and chair apparatus is provided which has specific provisions for conveniently carrying a rolled up sleeping bag. With the invention, an interconvertible backpack and chair apparatus is provided which is provided with strong, lightweight structural reinforcements to sustain the backpack chair in a chair formation. With the invention, an interconvertible backpack and chair apparatus is provided which has a backpack chair that is equipped with feet having a relatively broad surface area.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved interconvertible backpack and chair apparatus, comprising:

a first frame assembly which includes a top end, a bottom end, a front side, and a back side, said first frame assembly including a pair of retractable first legs, wherein said first legs are capable of supporting a rolled-up sleeping bag when said apparatus is in a backpack mode, and wherein said first legs are capable of serving as rear legs of a chair when said apparatus is in a chair mode, a pair of selectable lock assemblies supported by said first frame assembly for selectively locking said retractable first legs in an extended position, a strap connected to said first frame assembly enabling a person to carry said apparatus on one's back in a backpack mode, a first storage compartment attached to said top end of said first frame assembly, a flexible hinge assembly for attaching said first storage compartment to said first frame assembly, wherein said first storage compartment is capable of being located on said front side of said first frame assembly when said apparatus is in a backpack mode, and wherein said first storage compartment is capable of being shifted around said flexible hinge assembly and being located on said back side of said first frame assembly when said apparatus is in a chair mode, a second frame assembly which includes a back end, a front end, a bottom side, and a top side, a first hinge assembly which connects said bottom end of said first frame assembly to said back end of said second frame assembly, said first hinge assembly permitting said second frame assembly to be rotated with respect to said first frame assembly when said apparatus is shifted from a backpack mode to a chair mode and vice versa, a seat assembly attached to said top side of said first frame assembly, wherein said seat assembly is in alignment with said first storage compartment when said apparatus is in a backpack mode, and wherein said seat assembly is oriented at right angles to said first storage compartment when said apparatus is in a chair mode, a third frame assembly which includes a top end and a bottom end, and a second hinge assembly which connects said front end of said second frame assembly to said top end of said third frame assembly, said second hinge assembly permitting said third frame assembly to be rotated with respect to said second frame assembly when said apparatus is shifted from a backpack mode to a chair mode and vice versa.

2. The apparatus described in claim 1, further including:

a first transverse member connected between said pair of retractable first legs.

3. The apparatus described in claim 1, further including:

a second storage compartment attached to said bottom side of said second frame assembly, wherein said second storage compartment is in alignment with said first storage compartment when said apparatus is in a backpack mode, and wherein said second storage compartment is oriented at right angles to said first storage compartment when said apparatus is in a chair mode.

4. The apparatus described in claim 1 wherein:

said first frame assembly has an internal first width, said second frame assembly has an external second width and an internal third width, said seat assembly has an external second width, said third frame assembly has an external fourth said external second width is less than said internal first width such that said second frame assembly is nested within said first frame assembly when said apparatus is in a backpack orientation, and said external fourth width is less than said internal third width such that said third frame assembly is nested within said second frame assembly when said apparatus is in a backpack orientation.

5. The apparatus described in claim 1, further including:

a flexible reinforcement assembly connected between said first legs of said first frame assembly and said third frame assembly for preventing said third frame assembly from moving out of a parallel orientation distally with respect to said first legs.

6. The apparatus described in claim 1, further including:

flat feet assemblies connected to end portions of said third frame assembly and to end portions of said first legs of said first frame assembly.

7. The apparatus described in claim 6 wherein said flat feet assemblies include:

a leg-receiving portion, and a flat foot portion attached to said leg-receiving portion.

* * * * *